US006474591B1

(12) United States Patent
Granger

(10) Patent No.: US 6,474,591 B1
(45) Date of Patent: Nov. 5, 2002

(54) DEVICE FOR INSERTING A MATERIAL STRIP IN WIPING MATERIAL DISPENSING APPARATUS

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/700,831

(22) PCT Filed: Apr. 12, 1999

(86) PCT No.: PCT/FR99/00842

§ 371 (c)(1),
(2), (4) Date: Nov. 20, 2000

(87) PCT Pub. No.: WO99/60908

PCT Pub. Date: Dec. 2, 1999

(30) Foreign Application Priority Data

May 27, 1998 (FR) ..... 98 06874

(51) Int. Cl.[7] ..... B65H 19/10
(52) U.S. Cl. ..... 242/560; 242/560.1
(58) Field of Search ..... 242/560, 559, 242/559.3, 560.1

(56) References Cited

U.S. PATENT DOCUMENTS 4,106,684 A * 8/1978 Hartbauer et al. ..... 226/91
4,378,912 A * 4/1983 Perrin et al. ..... 242/55.3
4,807,824 A * 2/1989 Gains et al. ..... 242/55.3
5,400,982 A * 3/1995 Collins ..... 242/560
6,354,533 B1 * 3/2002 Jespersen ..... 242/560.1
6,363,824 B1 * 4/2002 Granger ..... 83/334

FOREIGN PATENT DOCUMENTS

| | | | |
|---|---|---|---|
| FR | 2739545 | 4/1997 | ..... A47K/10/32 |
| FR | 2746621 | 10/1997 | ..... A47K/10/36 |
| FR | 2751316 | 1/1998 | ..... B65H/35/00 |

* cited by examiner

*Primary Examiner*—Donald P. Walsh
*Assistant Examiner*—Mark J. Beauchaine
(74) *Attorney, Agent, or Firm*—Wall Marjama & Bilinski LLP

(57) ABSTRACT

A device for inserting a strip of material in a dispensing machine for material wipes of the type in which the machine includes a housing, a cover, the housing having end shields that support a reel holder, and a drum with a cutting device. The drum includes a cam associated with a start and return spring, a protection flap being located in front of the drum along with a pressure roller resting against the drum. The protection flap has an upper extension forming a support frame devised to accommodate a hinged secondary flap and a swivelling shaped plate is located behind the drum and capable of supporting a service roll that is being used up. The swivelling shaped plate cooperates with a mechanism capable of locking the secondary flap in position when a spare roll (RR) is being loaded and the service roll (RS) is positioned so that it can be used up.

8 Claims, 4 Drawing Sheets

DEVICE FOR INSERTING A MATERIAL STRIP IN WIPING MATERIAL DISPENSING APPARATUS

FIELD OF THE INVENTION

The invention relates to the technical field of dispensing machines for tissue-paper or similar type wipe materials intended for wiping the hands or toilet paper, the strip of material being folded or not folded.

BACKGROUND OF THE INVENTION

The Applicant has developed numerous automatic and semi-automatic versions of dispensing machines of this type.

The dispensing machines are of the type comprising a housing (1) capable of accommodating a swivel cover (3). The housing accommodates end shields (2) that support a reel holder (4) of wipe material in its upper part. In the lower part, a drum (5) is rotatably mounted with said end shields and is devised to accommodate the cutting device (6). The drum may be designed so that one of its ends has a cam (7) associated with a start and return. spring (8) one end **(8*a*) of which is attached to a finger (7*a*) associated with the cam and the other end (8*b*) of which is associated with a fixed part of one of the lateral end shields (2) of the housing. Generally speaking, in the lower part of the machine and towards the front facing the drum, there is a hinged protection flap (9) suitable to prevent entry of the user's hands and any unwanted contact with the cutting device. A pressure roller (10)** is located between the end shields of the housing and rests against the drum. The strip of material paid out from the reel is inserted between said drum and said pressure roller.

The machine is loaded on an ad hoc basis because service operators tasked with servicing and maintenance do not always wait for reels of material to be almost exhausted and this involves considerable wastage because operators even change reels that are not finished up in order to prevent machines becoming out of order.

In order to avoid the machine becoming unavailable because the reel of material has been exhausted, the Applicant has already proposed, in prior embodiments, the possibility of an operator taking a service roll that has not been used up and placing it at the rear of the drum in the bottom of the housing and fitting a fresh reel on the reel holder with a spare roll. In order to ensure finishing of the service roll, the drum was devised with means of directing the strip of material towards the area where it was transported by the drum. In implementing this, the Applicant envisaged designing the cover (3) of the machine with a horizontally arranged bar-shape at a certain height on the cover so that, when the cover was closed, it would come into contact with the end of the strip of material from the spare roll and guide it towards the transport and insertion area between the drum and the pressure component.

This embodiment, although satisfactory, nevertheless involves dispensing, for the specific period of time that it takes to finish up the service roll, two strips of paper, one from the service roll located at the bottom of the machine and another from the spare roll.

This embodiment is relatively impractical for such a loading operation.

The Applicant's Patent FR 2751316 discloses a machine of the above-mentioned type which includes a hinged flap located in front of the drum with a swivelling profiled plate behind the drum being capable of supporting the service roll as it is being used up, said plate co-operating with a mechanism capable of locking said flap in position when a spare roll is being loaded and positioning the service roll so that it can be finished up.

SUMMARY OF THE INVENTION

The purpose sought after according to the invention was therefore to overcome these drawbacks by suggesting a simple solution by initiating dispensing of the material from the spare roll only once the service roll had been exhausted.

According to a first aspect of the invention, the device for inserting a strip of material in a dispensing machine for material wipes of the type comprising a housing and a cover, the housing having end shields that support a reel holder, a drum with a cutting device with the drum including a cam associated with a start and return spring, a protection flap being provided in front of the drum and with a pressure roller resting against the drum, is distinctive in that the protection flap has an upper extension forming a support frame devised to accommodate a secondary hinged flap and in that a swivelling shaped plate is located behind the drum and is capable of supporting the service roll that is in the process of being finished up and in that said plate co-operates with a mechanism capable of locking the secondary flap in position in situations where the spare roll is being loaded and the service roll is being fitted so that it can be finished up.

These aspects and others will be apparent from the rest of the description.

BRIEF DESCRIPTION OF THE DRAWINGS

In order that the object of the illustrated invention may be more readily understood, non-exhaustive reference is made to the accompanying drawings in which.

DETAILED DESCRIPTION OF THE INVENTION

Figure 1:
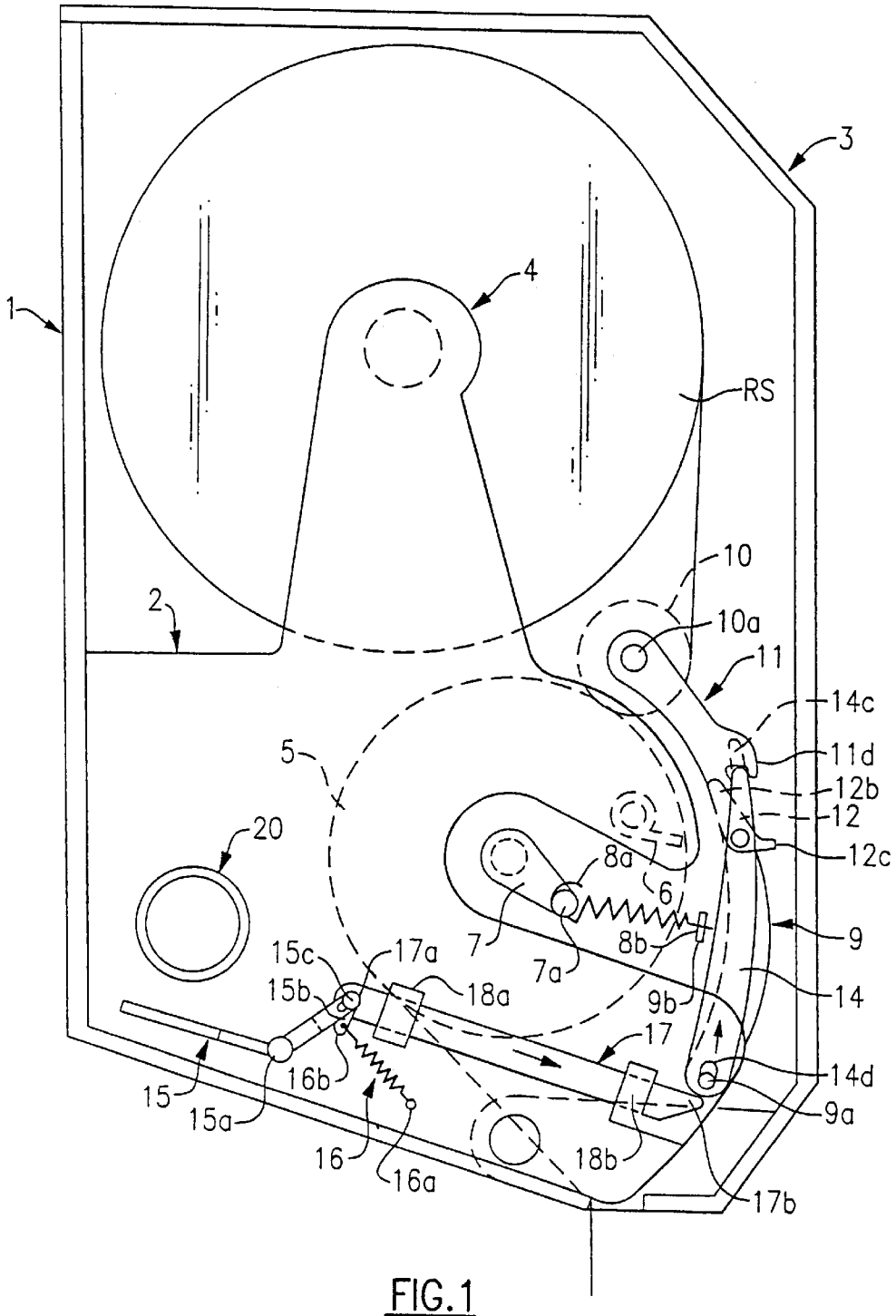
FIG. 1 is a profile view of the dispensing machine according to the invention when it is dispensing a reel of material normally.

In order that the object of the invention may be more readily understood, it is described below in a non-exhaustive manner, reference being made to the accompanying drawings.

The dispensing machine comprises the components described above.

Protection flap (9) has lateral protruding pins **(9*a*) that engage in and swivel in openings (2*b*) on the end shields (2*a*) of the housing. A return spring (8) elastically links said flap via a fixing lug (9*b*) to a protruding finger (7*a*) formed on cam (7)**.

According to the invention, protection flap (9) located facing drum (5) has an upper extension forming a support frame (11) separately mounted on or integrally moulded with said flap, this frame being devised to also accommodate a secondary flap (12) which is hinged relative to said frame. This frame advantageously has openings (11*a*) into which the hinge pins (12*a*) of said secondary flap can be inserted and passed through and, on its upper part, additional openings (11*b*) to accommodate and retain the pressure roller (10) through the end pins (10*a*) of the latter. Said secondary flap (12) has, on at least one side, a projecting protruding shape (12*b*) capable of constituting a support and retention plane as is described below. Said secondary flap (12) also comprises, longitudinally, a pad (12*c*) that is intended to be gripped and operated by the user as will become evident below. Secondary flap (12) has, around its swivel pin (12*a*), return means (13) of the kickover spring type, the ends (13*a*–13*b*) of which are attached respectively to the thickness of said secondary flap and rest on flap (9). This spring is twisted when flap (12) is swivelled forward and pushes flap (12) against flap (9).

Figure 2:
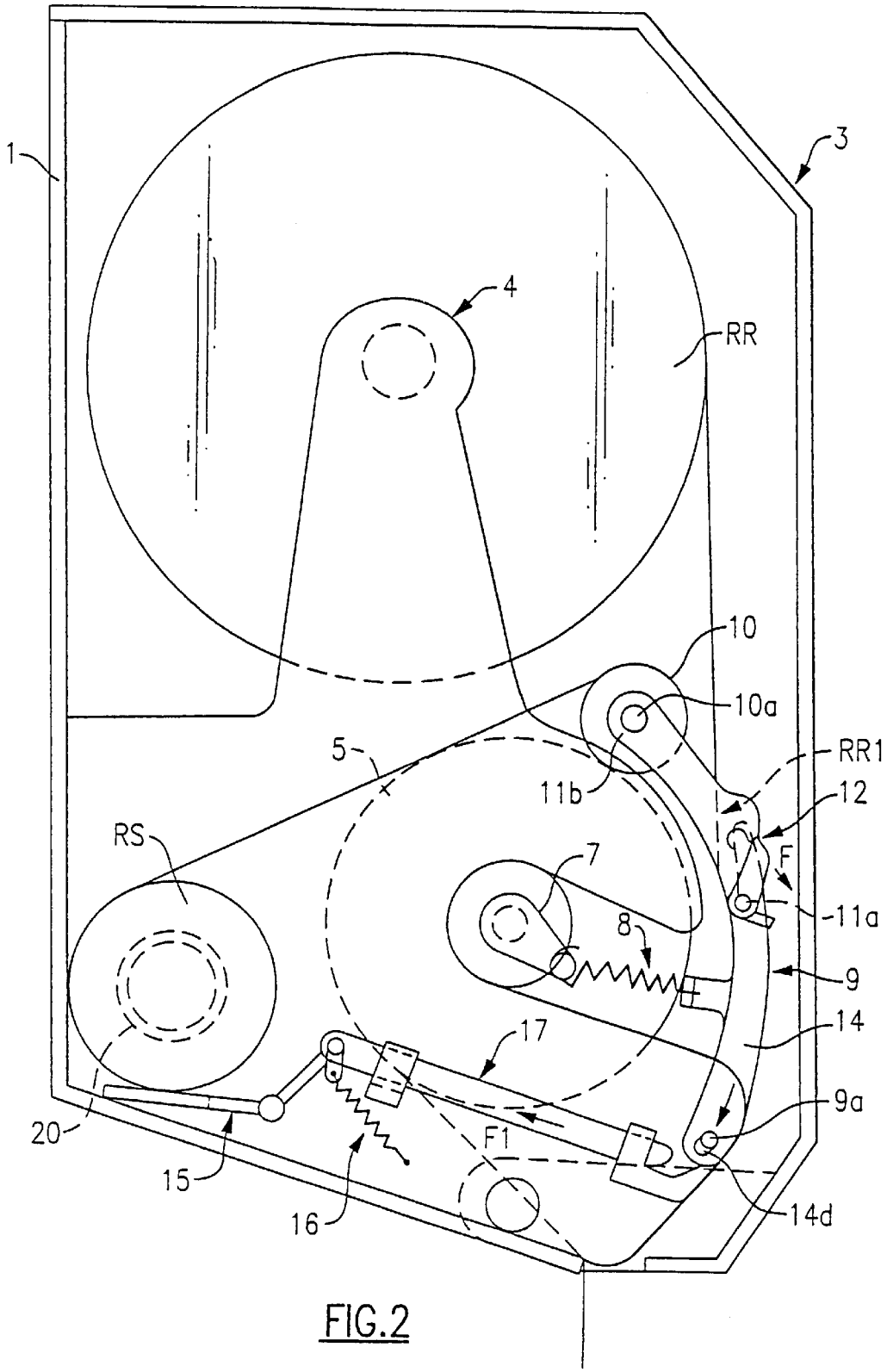
FIG. 2 is a similar view to FIG. 1 showing the presentation of the end of a strip of material from a spare roll when the service roll is in the process of being finished up.
Figure 3:
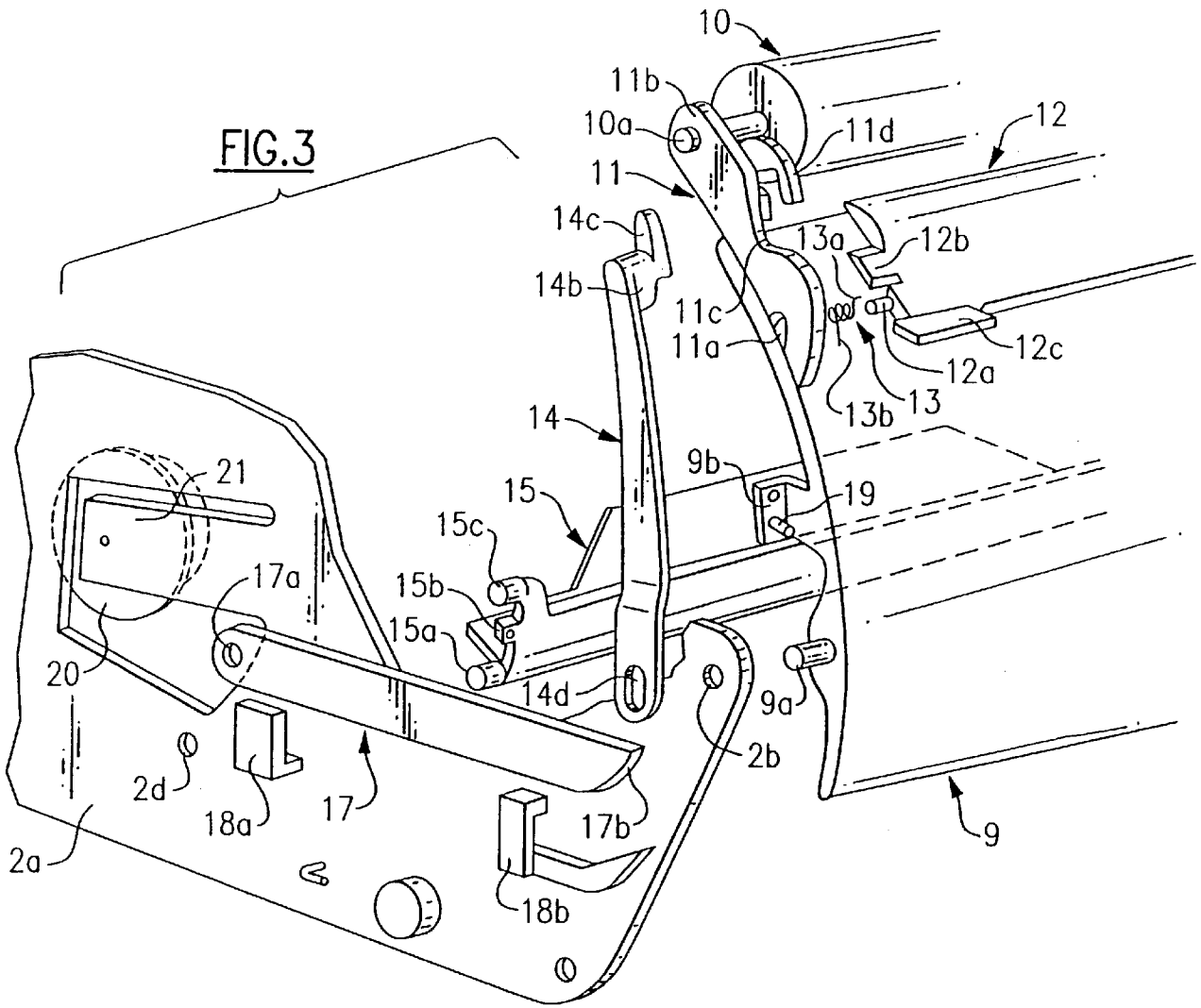
FIG. 3 is a partial perspective view before installing the device for inserting a strip of material between the drum and the pressure component and its setting mechanism.
Figure 4:
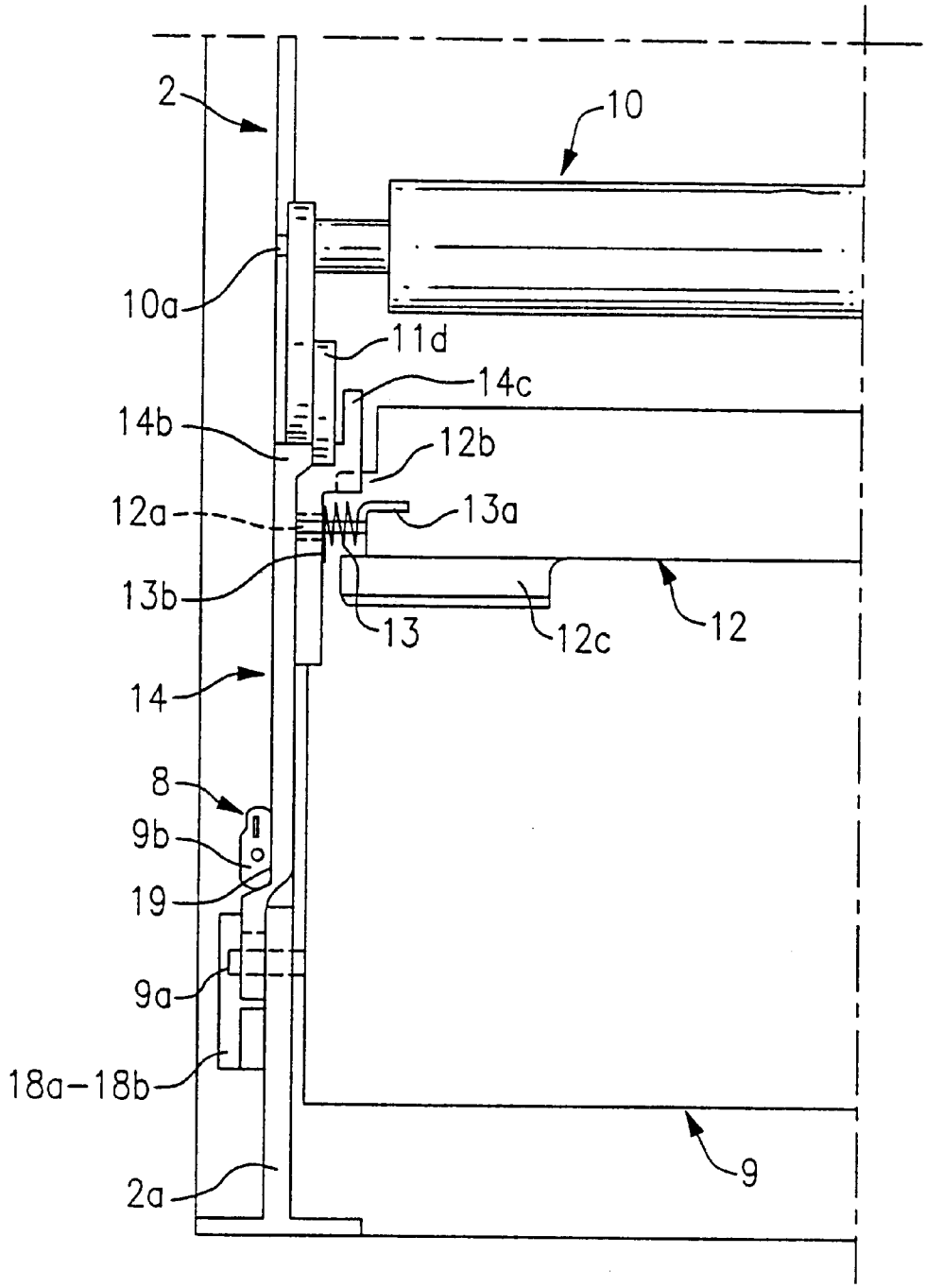
FIG. 4 is a front view according to FIG. 2.

Said secondary flap can therefore be swivelled, on the one hand, by the operator in order to raise it as shown in FIG. 2 of the drawings in the direction of arrow F and, on the other hand, by the effect of a setting mechanism described below.

The support frame (11) also has a central cut-out (11*c*) providing clearance for a shaped lever (14). Said support frame also has a hook shape (11*d*) that points towards the secondary flap.

According to the invention, the housing of the dispensing machine is capable of accommodating, at the bottom and behind drum (5), a curved V-shaped plate (15), the middle part of which or angulation area is hinged by a shaft (15*a*) that fits into openings (2*d*) on the end shields of the housing. This plate (15) is actuated by a return spring (16) one end (16*a*) of which is attached to the opposite-facing end shield (2*a*) of the housing or to the bottom of the latter whereas its other end (16*b*) is attached to a protruding finger (15*b*) on the forward part of said plate. It is therefore evident that the latter is capable of swivelling in opposition to the above-mentioned elastic return means. This swivelling and tensioning of said spring (16) are obtained when the operator positions the service roll (RS) that is almost finished up on plate (15). The weight of said service roll exceeds the resistance of the spring so that the plate swivels towards the rear as shown in FIG. 2.

The back end (17*a*) of a connecting rod (17) guided by lugs (18*a*–18*b*) formed on end shield (2*a*) of the housing is joined to above-mentioned plate (15) by a connecting pin (15*c*) or equivalent formed on plate (15). The front end (17*b*) of connecting rod (17) is designed with a cam-shaped profile. A shaped lever (14) is hinge-mounted on swivel pin (9*a*) of the main flap (9) through an appropriate oblong cut-out (14*d*) and a means of locking (19). The upper end of said lever (14) is bent (14*b*) and then forms a hook (14*c*). The bent part is capable of being located in the cut-out area (11*c*) of the frame whereas the hook part (14*c*) of said lever is positioned in the matching part (11*d*) of support frame (11).

This assembly operates as follows, reference being made to FIGS. 1 and 2:

During normal operation (FIG. 1), the main flap (9) is its closest to drum (5) thanks to the elastic return link (8) between the main flap and the cam at the end of the drum. The secondary flap (12) is lowered and rests against flap (9).

Plate (15) is in its non-swivelled position and, due to the return force of spring (16), it pushes forward rod (17) which lifts lever (14). The latter, through its hook part (14*c*), is released from secondary flap (12) by engaging with the matching part on support frame (11) or in a plane adjacent to said part.

In order to load a spare roll (RR), the operator lifts the service roll (RS), places it in the bottom of the machine on plate (15) which swivels due to the weight of said roll. The operator initially swivels secondary flap (12) forwards by pressing on grip pad (12*c*) which is associated with it, thereby creating space between the main flap and the drum in opposition to elastic means (13). The operator positions the spare reel (RR) allowing the free end (RR1) of the latter to hang opposite secondary flap (12). The operator can then reclose the cover of the machine.

In this phase, plate (15) has swivelled towards the back of the housing, thereby causing backward displacement, in the direction of arrow F1, of rod (17). The latter no longer supports level (14) and it drops due to gravity. The shaped part (14*b*) under hook (14*c*) rests against tab (12*b*) of flap (12), thus ensuring that the flap is locked in position. The strip (RR1) from the spare roll hangs between flap (12) and drum (5).

When the service roll (RS) is exhausted, the weight of the latter decreases until it ultimately corresponds only to that of the actual spindle of the reel. This weight is less than the return force of spring (16), thereby causing plate (15) to rise. This swivelling causes forward displacement of rod (17) whose end comes into contact with lever (14), thus releasing secondary flap (12) which, due to the resilience of spring (13), returns to its initial position and pushes the end of the spare strip of material between the drum and the pressure component.

In an alternative embodiment, the service roll is supported by end fittings (20) mounted on tabs (21) capable of elastic deformation located on the back of the housing. A service roll which is nearly finished up has a certain diameter which causes it to push plate (15) in opposition to its elastic return means (16). The reducing diameter of the service roll causes gradual lifting of the plate until rod (17) and lever (14) come into contact and release flap (12).

The advantages are clearly apparent from the invention. The simplicity of the mechanisms used and the automatic operation of the machine which makes it possible to prevent any wastage of material should be emphasised.

What is claimed is:

1. A wipe material dispensing machine comprising a device for inserting a strip of material in a dispensing machine for material wipes, said machine comprising a housing, a cover, the cover having end shields that support a reel holder, a drum with a cutting device, the drum including a cam associated with a start and return spring, a hinged protection flap being located in front of the drum, a swivelling profiled plate being located behind the drum and capable of constituting a support for a service roll as it is being used up, said plate cooperating with a mechanism capable of locking said protection flap in position when a spare roll is being loaded and positioning the service roll so that it can be used up, wherein the protection flap has an upper extension forming a support frame devised to accommodate an articulated secondary flap, a swivelling shaped plate being located behind the drum and capable of supporting the service roll that is being finished up, said shaped plate cooperating with a thrust and setting mechanism capable of locking the secondary flap in position when a spare roll (RR) is being loaded and the service roll (RS) is being positioned so that it can be finished up.

2. A dispensing machine as claimed in claim 1 wherein said shaped plate is mounted so that it is hinged relative to the end shield of the housing and is subjected to a swivelling movement in opposition to a return spring, said plate having a protruding shape allowing linking and connection with one of the elements of the thrust and setting mechanism of the secondary flap.

3. A dispensing machine as claimed in claim 2 wherein the shaped plate includes a protruding finger used to attach one end of the spring, the other end of the spring being attached to an end shield of the housing.

4. A dispensing machine as claimed in claim 1 wherein the mechanism for setting said protection flap includes a connecting rod guided on one of the end shields of the housing, the rear end of said rod being connected to the shaped plate and its front part being shaped in order to cooperate with a lever capable of locking said protection flap in position.

5. A dispensing machine as claimed in claim 4 wherein the connecting rod has a forward end shaped as a cam in order to cooperate with the lower part of said lever and in that said lever is hinge-mounted on a swivel pin of the protection flap in an oblong cutout, the upper end of said lever being shaped, bent and forming a hook in its upper part.

6. A dispensing machine as claimed in claim 1 wherein the protection flap is mounted so that it swivels relative to the housing in opposition to an elastic return means, one end of which is attached to said protection flap and the other end of which is attached to the cam.

7. A dispensing machine as claimed in claim 1 wherein the secondary flap has, on one side, a protruding shape constituting a support plane for the hooked end of said lever in the locked position when the protection flap swivels forward when the spare roll (RR) is fitted and in that said secondary flap is mounted so that it swivels in opposition to a return means.

8. A dispensing machine as claimed in claim 1 wherein the service roll is supported by end fittings mounted on tabs capable of elastic deformation on the back of the housing, in that a service roll that is being finished up has a certain diameter which causes it to push the plate in opposition to its elastic return means and in that the reduction in the diameter of the service roll causes gradual lifting of the plate until the rod and the lever come into contact and release the flap.

* * * * *